United States Patent [19]

Brook

[11] 4,276,673

[45] Jul. 7, 1981

[54] FLOOR WAX STRIPPING APPARATUS

[76] Inventor: Edward E. Brook, 310 United Founders Life Tower, Oklahoma City, Okla. 73112

[21] Appl. No.: 105,323

[22] Filed: Dec. 19, 1979

[51] Int. Cl.[3] ..... A47L 11/14

[52] U.S. Cl. ..... 15/49 C; 51/176

[58] Field of Search ..... 15/23, 49 R, 49 C, 50 C, 15/98, 52; 51/170 PT, 170 T, 176, 177

[56] References Cited

U.S. PATENT DOCUMENTS

| | | | |
|---|---|---|---|
| 942,830 | 12/1909 | Hoy . | |
| 1,625,667 | 4/1927 | Lee | 15/49 C |
| 1,907,904 | 5/1933 | Van Emburg et al. . | |
| 1,936,449 | 11/1933 | Marchi . | |
| 2,097,655 | 11/1937 | Marchi et al. | 51/176 X |
| 2,179,963 | 11/1939 | Spadone | 15/49 C X |
| 2,680,942 | 6/1954 | Portnow | 51/176 |

FOREIGN PATENT DOCUMENTS

| | | | |
|---|---|---|---|
| 104748 | 7/1924 | Switzerland | 15/49 C |

*Primary Examiner*—Edward L. Roberts
*Attorney, Agent, or Firm*—Robert K. Rhea

[57] ABSTRACT

A handle equipped wheel supported horizontal base rotatably supports a motor having its drive shaft parallel with the plane of the base. A vertically adjustable forward platform on the base transversely supports a split sleeve clamp for receiving one end portion of a flexible drive shaft axially connected at its other end with the motor drive shaft. The clamp connected end of the flexible shaft is axially secured to a scrub brush rotating in a vertical plane laterally of the base platform for frictional contact with a floor surface adjacent a mopboard or wall.

4 Claims, 5 Drawing Figures

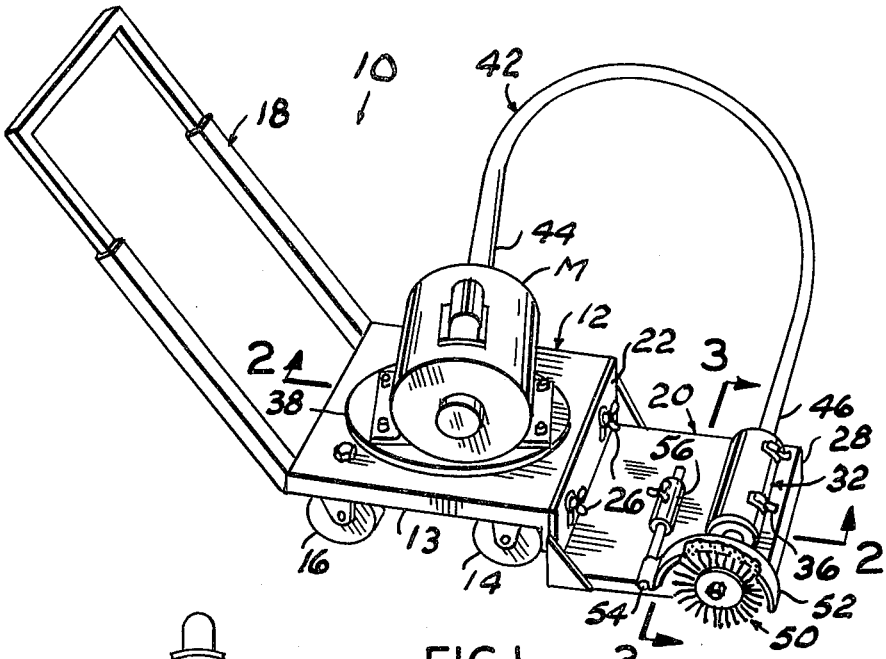
FIG.1
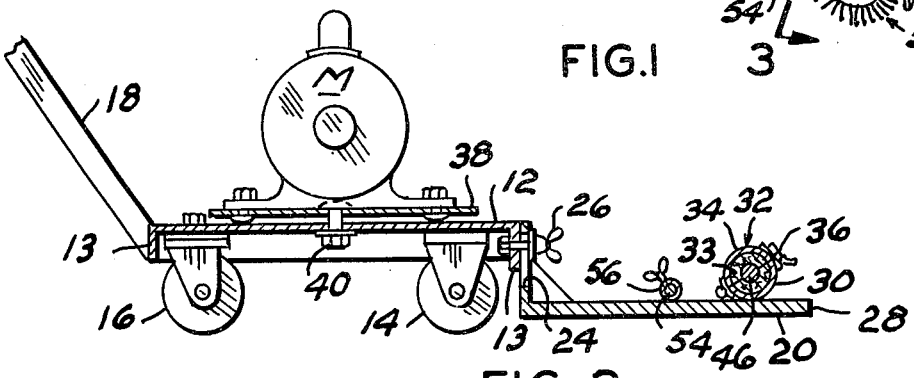
FIG. 2
FIG. 4
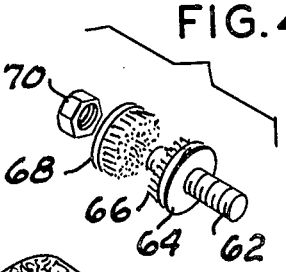
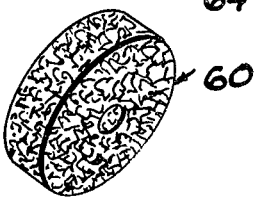
FIG. 5
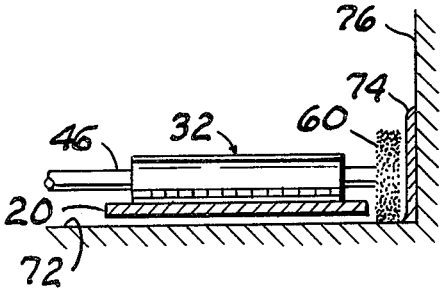
FIG. 3

FLOOR WAX STRIPPING APPARATUS

BACKGROUND OF THE INVENTION

1. Field of the Invention

The present invention relates to building maintenance and more particularly to a floor wax stripping apparatus.

It is common practice to remove floor wax by using a conventional floor scrubbing and wax buffing machine in which a scouring pad replaces the wax buffing pad wherein the scouring pad is horizontally rotated in contact with the floor. This type of wax removing apparatus functions satisfactorily with the exception that a relatively narrow strip of approximately one or two inches adjacent the wall or mopboard is not removed thus requiring this area to be stripped of wax by manually scrubbing the area.

2. Description of the Prior Art

The most pertinent prior art is believed to be U.S. Pat. Nos. 942,830; 1,907,904 and 1,936,449.

The Hoy U.S. Pat. No. 942,830 discloses a roller supported angularly rotated frame, having a horizontal axle, around which an endless dressing pad or sheet of sandpaper is disposed for contacting a floor. One end of the axle is connected with an elongated handle movable in a vertical plane about the axis of the axle for reversing direction of travel of the frame. The handle supports manually operated drive wheels drivably connected with the frame axle for angular rotation of the frame in contact with a floor.

The Emburg et al U.S. Pat. No. 1,907,904 discloses a handle manipulated flexible drive shaft having a sanding wheel mounted thereon for sanding a floor adjacent a mopboard which also features vacuum suction means for removing dust.

The DeMarchi U.S. Pat. No. 1,936,449 discloses a mobile platform having a motor driving a jack shaft in turn driving a flexible shaft having a grinding head secured to its end opposite the jack shaft. The flexible shaft and grinding head are supported by a floor contacting base when manually moved across a floor by handles and features a vacuum suction tube for removing dust.

This invention is distinctive over these patents by providing a mobile platform having a motor driving a flexible shaft connected at one end with the motor and adjustably supported at its other end with respect to the surface of the floor by a platform for disposing a wax removing brush adjacent the floor and a mopboard wherein manual linear movement of the device removes wax from the floor.

SUMMARY OF THE INVENTION

A handle equipped wheel supported generally horizontal frame rotatably supports a motor having the axis of its drive shaft horizontally disposed. A horizontal forward platform extension of the base, lying in a plane below the plane of the base, is vertically adjustably secured thereto. A split sleeve clamp, transversely supported by the forward end portion of the platform, grips one end of an elongated flexible shaft axially connected at its other end to the motor drive shaft. The platform mounted end of the flexible shaft is axially secured to a cylindrical wax removing disk for angular rotation in a vertical plane at one side of the platform and in frictional contact with the floor surface. The disk equipped end of the shaft may be removed from the platform clamp for positioning the disk against the vertical plane of a wall or other wall areas, such as the corners of a room, not capable of being cleaned by a floor machine.

The principal object is to provide a power driven wax stripping disk or brush for removing floor wax adjacent a wall or mopboard and in which the disk or brush may be manually positioned against other surface areas not capable of being stripped of wax by a wax removing machine.

BRIEF DESCRIPTION OF THE DRAWINGS

FIG. 1 is a perspective view of the device with a portion of its brush guard broken away for clarity;

FIG. 2 is a fragmentary vertical cross sectional view taken substantially along the line 2—2 of FIG. 1 with the flexible drive shaft removed;

FIG. 3 is a fragmentary vertical cross sectional view taken substantially along the line 3—3 of FIG. 1 illustrating the position of the wax removing brush adjacent a mopboard;

FIG. 4 is an exploded perspective view of a fibrous brush holding head; and, FIG. 5 is a perspective view of a fibrous brush used by the device.

DESCRIPTION OF THE PREFERRED EMBODIMENT

Like characters of reference designate like parts in those figures of the drawings in which they occur.

In the drawings:

The reference numeral 10 indicates the device, as a whole, comprising a handle equipped mobile frame. The frame 12 comprises a generally horizontal plate having a depending flanged edge 13 supported by a pair of forward wheels 14 and a pair of rearward caster wheels 16, only one of each being shown. The rearward end of the frame is provided with angularly upward inclined telescoping box-channel handles 18 for manipulating the frame 12.

A horizontal platform 20 projects forwardly of the frame 12 in a plane below the plane of the frame 12 and is vertically adjustably secured thereto by an upstanding flange 22 at its rearward end. The flange 22 is provided with a pair of vertical slots 24 for receiving thumb screw bolts 26 projecting through suitable apertures formed in the forward depending flange of the frame 12. Adjacent its forward end 28, the platform 20 has transversely secured thereto one-half 30 of a cylindrical split sleeve clamp 32 containing a resilient sleeve 44. The clamp 32 is preferably centrally disposed between opposing sides of the platform for the reasons presently apparent. The other or top half 34 of the clamp is hingedly connected to the bottom half 30 and fastened by suitable toggle link clamps 36.

The frame 12 supports a turntable 38 centrally connected to the frame top by a bolt axle 40 for angular rotation in a horizontal plane.

A motor M, connected with a source of electrical energy, not shown, is mounted on the turntable 38 and is rotatable therewith. The horizontal drive shaft of the motor is coaxially connected with one end of an elongated flexible shaft 42. The shaft 42 is conventional, characterized by a sheath contained flexible core angularly rotated by the motor. The other end portion 46 of the shaft 42 is surrounded by the split clamp 32 with the end of the shaft core opposite the motor projecting beyond one side of the platform 20. A cylindrical-like brush 50, preferably formed from synthetic material, such as Nylon, is coaxially connected to the end of the flexible shaft core projecting beyond the platform 20.

A fender-like dust guard 52 loosely overlies the brush 50 and is normally held in brush guard position by a rod 54 extending transversely of the platform 20 rearwardly of the split clamp 32 angularly rotatable in a set screw equipped sleeve 56 centrally secured to the platform 20.

Synthetic resilient fibrous material circular buffing pads are conventionally used with floor scrubbing machines wherein the pad underlies the scrubbing brush. A relatively small diameter circular center section 60 (FIG. 5) of these fibrous circular buffing pads are cut out during manufacture and are normally discarded. These circular center sections 60 are utilized by the device of this invention and are connected to the shaft 42 in place of the brush 50. This is accomplished by a stub shaft 62 which is threadedly engaged with the flexible shaft 42 and includes a washer-like flange 64 having a plurality of synthetic material prongs 66 generally perpendicular to one face of the flange for engaging one face of the pad 60. A similar prong equipped companion flange 68 engages the opposite side of the disk 60 with the two flanges 62 and 68 held in place in gripping relation with respect to the disk 60 by a nut 70 which, by the resilience of the pad, disposes the nut within the plane of the adjacent side of the pad 60.

Operation

In operation, the brush or disk and guard are disposed on a selected side of the platform 20 and it is vertically adjusted by the wing nuts 26 so that the brush 50 or disk 60 bears against the surface 72 of a floor. The device 10 is then manually moved by the handle 18 so that the disk 60 is disposed on a marginal edge of the floor 72 adjacent a mopboard 74 secured to a wall 76 wherein forward or rearward movement of the device 10, with the motor M running and revolving the disk 60, removes wax, or the like, from the surface of the floor 72 without damage to the mopboard.

The device is also useful for removing wax, dirt or grime from normally inaccessible areas around bathroom fixtures, walls or floor areas by removing the brush equipped end of the flexible shaft from the split clamp 32 and applying the brush or disk to the area to be cleaned by manually grasping the end portion of the flexible shaft adjacent the brush or disk.

Obviously the invention is susceptible to changes or alterations without defeating its practicability. Therefore, I do not wish to be confined to the preferred embodiment shown in the drawings and described herein.

I claim:

1. A machine for removing wax from the marginal edge of a floor adjacent a mopboard, or the like, comprising:

mobile frame means including a handle at one side thereof for moving the frame means across a floor surface;

a motor having a horizontally disposed drive shaft;

means mounting said motor on said frame means for angular rotation of the motor about a vertical axis;

a flexible shaft connected at one end portion with and driven by said drive shaft;

a floor wax removing disk or brush coaxially secured to the other end of said flexible shaft; and, means connecting said flexible shaft other end portion with said frame means for vertical movement toward and away from the surface of a floor with the plane of said disk or brush disposed vertically and parallel with the direction of movement of said frame means.

2. The machine according to claim 1 in which said connecting means includes:

a horizontal platform vertically adjustably secured to said frame means opposite the handle; and, a split sleeve clamp overlying and secured to said platform transversely of the direction of travel of said frame means.

3. The machine according to claim 1 or 2 in which said mounting means comprises:

a plate horizontally overlying and centrally journalled by said frame means.

4. The machine according to claim 3 and further including:

a dust guard supported by said platform for movement in a vertical plane toward and away from the upper limit of said disk or brush.

* * * * *